US009721547B2

(12) United States Patent
Mori

(10) Patent No.: US 9,721,547 B2
(45) Date of Patent: Aug. 1, 2017

(54) PEDAL DEVICE FOR ELECTRONIC PERCUSSION INSTRUMENT

(71) Applicant: ROLAND CORPORATION, Shizuoka (JP)

(72) Inventor: Yoshiaki Mori, Shizouka (JP)

(73) Assignee: ROLAND CORPORATION, Shizuoka (JP)

( * ) Notice: Subject to any disclaimer, the term of this patent is extended or adjusted under 35 U.S.C. 154(b) by 29 days.

(21) Appl. No.: 14/736,281

(22) Filed: Jun. 11, 2015

(65) Prior Publication Data

US 2016/0012806 A1 Jan. 14, 2016

(30) Foreign Application Priority Data

Jul. 9, 2014 (JP) ..... 2014-141830

(51) Int. Cl.

*G10D 13/00* (2006.01)
*G10H 1/34* (2006.01)
*G10H 3/00* (2006.01)

(52) U.S. Cl.

CPC ..... *G10D 13/006* (2013.01); *G10D 13/00* (2013.01); *G10H 1/348* (2013.01); *G10H 2250/435* (2013.01)

(58) Field of Classification Search

CPC ..... G10D 13/00; G10D 13/006; G10H 1/348; G10H 2250/435

(Continued)

(56) References Cited

U.S. PATENT DOCUMENTS 4,200,025 A * 4/1980 Currier ..... G10D 13/006 84/422.1
6,979,770 B2 * 12/2005 Hampton, Jr. ..... G10D 13/006 84/422.1

(Continued)

FOREIGN PATENT DOCUMENTS

JP 04-081196 7/1992
JP 09-097075 4/1997

(Continued)

OTHER PUBLICATIONS

Alternate Mode Inc., http://www.alternatemode.com/ekic-ehat.shtml, retrieved on Jan. 23, 2014, "Alternate Mode eKIC and eHAT Bass Drum and Hi-Hat Triggers".

(Continued)

*Primary Examiner* — David Warren
*Assistant Examiner* — Christina Schreiber
(74) *Attorney, Agent, or Firm* — Jianq Chyun IP Office

(57) ABSTRACT

A pedal device for an electronic percussion instrument is provided, wherein first and second detection means for detecting a rotation of a pedal by different methods are alternatively disposed in a base. The pedal has a pressing part on a lower surface side. The base includes a first portion located under the pressing part for supporting the first detection means, and a second portion located around the first portion for supporting the second detection means. The first portion supports the first detection means such that a first pressed part of the first detection means is disposed on a displacement trajectory of the pressing part that displaces with the rotation of the pedal, and the second portion disposes the second detection means such that a second pressed part of the second detection means is disposed on the displacement trajectory of the pressing part.

20 Claims, 7 Drawing Sheets

(58) Field of Classification Search
USPC ..... 84/746
See application file for complete search history.

(56) References Cited

U.S. PATENT DOCUMENTS

| | | | | |
|---|---|---|---|---|
| 7,470,847 | B2 * | 12/2008 | Kitagawa | G10H 1/348 84/422.1 |
| 8,389,848 | B1 * | 3/2013 | Baker | G10H 1/348 84/612 |
| 8,546,676 | B2 * | 10/2013 | Hashimoto | G10H 1/348 74/478 |
| 8,859,870 | B2 * | 10/2014 | Yamane | G10D 13/024 84/422.1 |
| 2006/0060062 | A1 * | 3/2006 | Dyk | G10D 13/065 84/422.1 |
| 2008/0098873 | A1 * | 5/2008 | Kitagawa | G10H 1/348 84/422.1 |
| 2008/0196574 | A1 * | 8/2008 | Kjellgren | G10D 13/006 84/422.1 |
| 2011/0061518 | A1 * | 3/2011 | Iwamoto | G10H 1/348 84/746 |
| 2011/0214557 | A1 * | 9/2011 | Arayama | G10H 1/32 84/746 |
| 2012/0031253 | A1 * | 2/2012 | Yoshino | G10D 13/006 84/422.1 |
| 2012/0222542 | A1 * | 9/2012 | Hashimoto | G10H 1/348 84/746 |
| 2012/0266737 | A1 * | 10/2012 | Mori | G10D 13/006 84/421 |
| 2014/0116229 | A1 * | 5/2014 | Mori | G10D 13/02 84/415 |
| 2015/0187343 | A1 * | 7/2015 | Mori | G10D 13/006 84/746 |
| 2015/0371622 | A1 * | 12/2015 | Beaty | G10H 1/46 84/633 |

FOREIGN PATENT DOCUMENTS

| | | |
|---|---|---|
| JP | 2008-145464 | 6/2008 |
| JP | 2013-195656 | 9/2013 |
| JP | 2013-250305 | 12/2013 |

OTHER PUBLICATIONS

Drum Tech, http://www.drumtech.com/fat.html, retrieved on Jan. 21, 2014, "Fat Pedal".

drumchops.com, http://store.drumchops.com/Merchant2/merchant.mvc?Screen=PROD, retrieved on Jan. 23, 2014, "FATpedal Trigger Pedal".

Drum Tech, http://www.drumtech.com/hat.html, retrieved on Jan. 21, 2014, "Hat Pedal".

drumchops.com, http://store.drumchops.com/Merchant2/merchant.mvc?Screen=PROD&St, retrieved on Jan. 23, 2014, "HATpedal Trigger HiHat".

* cited by examiner

PEDAL DEVICE FOR ELECTRONIC PERCUSSION INSTRUMENT

CROSS-REFERENCE TO RELATED APPLICATIONS

This application claims the priority benefit of Japan application serial no. 2014-141830, filed on Jul. 9, 2014. The entirety of the above-mentioned patent application is hereby incorporated by reference herein and made a part of this specification.

BACKGROUND OF THE INVENTION

Field of the Invention

The invention relates to a pedal device for an electronic percussion instrument. In particular, the invention relates to a pedal device for an electronic percussion instrument, which is capable of accurately detecting rotation of a pedal and achieves part commonality.

Description of Related Art

Among pedal devices that have a pedal configured to rotate when stepped by the player, some pedal devices simulate hi-hat or bass drum to be used in an electronic percussion instrument with a detection means for detecting rotation of the pedal.

The pedal device for the electronic percussion instrument that simulates hi-hat and the pedal device for the electronic percussion instrument that simulates bass drum may use different detection means. In such a case, traditionally different pedal devices that have different structures for disposing the detection means are used in the electronic percussion instrument that simulates hi-hat and the electronic percussion instrument that simulates bass drum.

Regarding this, Japanese Patent Publication No. 2013-250305 (FIG. 1, etc.) discloses a pedal device that can be used in both the electronic percussion instrument that simulates hi-hat and the electronic percussion instrument that simulates bass drum.

According to Japanese Patent Publication No. 2013-250305, however, the first disposing part (first portion) for disposing the first sensor (first detection means) is closer to the rotation shaft than the coil spring (force applying means). In addition, the second disposing part (second portion) for disposing the second sensor (second detection means) is farther away from the rotation shaft than the coil spring.

In this situation, in the foot board (pedal), the portion pressing the first sensor is closer to the rotation shaft than the portion pressing the second sensor. Thus, the displacement of the portion that presses the first sensor as the foot board rotates is small. As a result, compared with the second sensor, the first sensor has low detection accuracy with respect to the rotation of the foot board.

SUMMARY OF THE INVENTION

In view of the above, the invention provides a pedal device for an electronic percussion instrument, which is capable of accurately detecting rotation of a pedal and achieves part commonality.

According to an embodiment of the invention, a first detection means or a second detection means is alternatively disposed in a base of the pedal device for the electronic percussion instrument. Thus, the pedal device can be used as a component of the electronic percussion instrument including the first detection means or the electronic percussion instrument including the second detection means.

Besides, one longitudinal end side of the pedal is rotatably and pivotally supported by the base. A pressing part is formed at the other longitudinal end side of the pedal. That is, the pressing part is disposed away from a rotation shaft of the pedal. The above configuration ensures a large displacement range when the pressing part displaces with the rotation of the pedal. Furthermore, the first detection means disposed on a first portion or the second detection means disposed on a second portion is disposed on a displacement trajectory of the pressing part. Thus, the electronic percussion instrument including the first detection means and the electronic percussion instrument including the second detection means can both detect the rotation of the pedal accurately.

Hence, according to an embodiment of the invention, the pedal device can be used as a component of two different types of electronic percussion instruments, and both can detect the rotation of the pedal accurately.

According to another embodiment of the invention, in the pedal device for the electronic percussion instrument, the second portion supports a second sensor in a state that the second sensor is separated from the first portion and does not contact the first portion. Thus, in addition to the aforementioned effects, damage of the second sensor caused by contact with the first portion can be avoided.

According to another embodiment of the invention, in the pedal device for the electronic percussion instrument, the second portion is formed on two sides sandwiching the first portion and located such that a distance from the second portion to the rotation shaft of the pedal is equal to a distance from the first portion to the rotation shaft of the pedal. Thus, in addition to the aforementioned effects, the structure of the pressing part (structure for disposing the second pressed part on the displacement trajectory of the pressing part) can be simplified to reduce the production costs of the whole electronic percussion instrument.

According to another embodiment of the invention, in the pedal device for the electronic percussion instrument, a first rotation angle of the pedal required for causing the pressing part to contact the first pressed part supported by the first portion differs from a second rotation angle of the pedal required for causing the pressing part to contact the second pressed part supported by the second portion. Therefore, for the electronic percussion instrument including the first detection means and the electronic percussion instrument including the second detection means, the rotation angle of the pedal required for causing the pressing part to contact the first detection means or the second detection means can be set separately to differentiate the operational feelings the player feels when playing the electronic percussion instruments.

Even if the pedal device is used in different types of electronic percussion instruments, the operational feeling can be adjusted corresponding to the types of the electronic percussion instruments. Thus, in addition to the aforementioned effects, part commonality can be achieved and the operational feeling during the playing can be improved.

According to another embodiment of the invention, in the pedal device for the electronic percussion instrument, a first rotation angle of the pedal that is restricted in a case when the first pressed part is supported by the first portion differs from a second rotation angle of the pedal that is restricted in a case when the second pressed part is supported by the second portion. Therefore, for the electronic percussion instrument including the first detection means and the electronic percussion instrument including the second detection means, the rotation range of the pedal can be set separately to differentiate the operational feelings the player feels when playing the electronic percussion instrument.

Even if the pedal device is used in different types of electronic percussion instruments, the operational feeling can be adjusted corresponding to the types of the electronic percussion instruments. Thus, in addition to the aforementioned effects, part commonality can be achieved and the operational feeling during the playing can be improved.

According to another embodiment of the invention, in the pedal device for the electronic percussion instrument, the second portion is located closer to the pressing part than the first portion. Thus, in addition to the aforementioned effects, displacement of the second pressed part due to the rotation of the pedal can be restricted by the second portion. Therefore, the structure of the second detection means (structure for separating the second sensor from the first portion and preventing the first portion from contacting the second sensor) can be simplified to reduce the production costs of the whole electronic percussion instrument.

According to another embodiment of the invention, in the pedal device for the electronic percussion instrument, when the base is placed on the floor, the second portion supports the second pressed part in a state that the second pressed part inclines relative to the floor. In this way, the pressing force the pressing part applies on the second pressed part can be easily applied in the thickness direction of the second pressed part. Thus, in addition to the aforementioned effects, the shearing force applied on the second pressed part can be reduced to prevent the second pressed part from damaging soon. Furthermore, the pressing force from the pressing part can be transferred to the second pressed part efficiently. Consequently, the rotation of the pedal can be accurately detected by the second sensor.

According to another embodiment of the invention, in the pedal device for the electronic percussion instrument, when the base is placed on the floor, the second portion inclines relative to the floor. In this situation, the pressing force the pressing part applies on the second pressed part can be easily applied in a direction substantially perpendicular to the second portion. The second pressed part can be compressed efficiently in the thickness direction thereof between the pressing part and the second portion. Thus, in addition to the aforementioned effects, the shearing force applied on the second pressed part can be reduced to prevent damaging the second pressed part.

According to another embodiment of the invention, in the pedal device for the electronic percussion instrument, in an initial stage where the pressing part and the second pressed part comes in contact with each other, the pressing part and the second pressed part contact each other at a point or in a line. Thus, in addition to the aforementioned effects, the impact sound generated by collision between the pressing part and the second pressed part can be reduced.

According to another embodiment of the invention, in the pedal device for the electronic percussion instrument, the pedal and the pressing part are made of a plate-shaped member that is made of a steel plate. Thus, in addition to the aforementioned effects, the dead weight of the pedal can be increased in comparison with the conventional pedal made of a resin material or aluminum. In this way, the pedal is provided with moderate inertia. The operational feeling during the playing is enhanced.

In addition, the pedal and the pressing part are formed integrally by bending a plate-shaped member. The production costs of the pedal device can be reduced.

The invention further provides a base of a pedal device for an electronic percussion instrument, which is capable of accurately detecting rotation of a pedal and achieves part commonality.

According to an embodiment of the invention, the base of the pedal device for the electronic percussion instrument is placed on a floor and rotatably and pivotally supports one longitudinal end side of the pedal through a rotation shaft, and the pedal includes a pressing part on a lower surface side of the pedal at the other longitudinal end side, wherein a first detection means or a second detection means for detecting the rotation of the pedal by different methods is alternatively disposed in the base. The base includes a first portion located under the pressing part for supporting the first detection means, and a second portion located around the first portion for supporting the second detection means. The first portion supports the first detection means such that the first detection means is disposed on a displacement trajectory of the pressing part that displaces with the rotation of the pedal. The second portion disposes the second detection means such that the second detection means is disposed on the displacement trajectory of the pressing part that displaces with the rotation of the pedal. A height of the first portion is different from a height of the second portion. The second portion is formed on two sides sandwiching the pedal and located such that a distance from the second portion to the rotation shaft of the pedal is equal to a distance from the first portion to the rotation shaft of the pedal.

According to another embodiment of the invention, in the base of the pedal device for the electronic percussion instrument, the second portion is located above the first portion.

According to another embodiment of the invention, in the base of the pedal device for the electronic percussion instrument, the second portion is located below the first portion.

According to another embodiment of the invention, in the base of the pedal device for the electronic percussion instrument, when the base is placed on the floor, the second portion inclines relative to the floor.

According to another embodiment of the invention, in the base of the pedal device for the electronic percussion instrument, the first detection means includes a first pressed part disposed on the first portion and a first sensor detecting whether the first pressed part is pressed by the pressing part. The second detection means includes a second pressed part disposed to bridge the second portion and a second sensor detecting whether the second pressed part is pressed by the pressing part. The first portion supports the first detection means such that the first pressed part is disposed on the displacement trajectory of the pressing part that displaces with the rotation of the pedal. The second portion disposes the second detection means such that the second pressed part is disposed on the displacement trajectory of the pressing part that displaces with the rotation of the pedal.

According to another embodiment of the invention, in the base of the pedal device for the electronic percussion instrument, the second portion supports the second sensor installed on the second pressed part in a state that the second sensor faces the first portion and is separated from the first portion and does not contact the first portion.

According to another embodiment of the invention, in the base of the pedal device for the electronic percussion instrument, a first rotation angle of the pedal required for causing the pressing part to contact the first pressed part supported by the first portion differs from a second rotation angle of the pedal required for causing the pressing part to contact the second pressed part supported by the second portion.

According to another embodiment of the invention, in the base of the pedal device for the electronic percussion instrument, a first rotation angle of the pedal that is restricted in a case when the first pressed part is supported by the first portion differs from a second rotation angle of the pedal that is restricted in a case when the second pressed part is supported by the second portion.

According to another embodiment of the invention, in the base of the pedal device for the electronic percussion instrument, when the base is placed on the floor, the second portion supports the second pressed part in a state that the second pressed part inclines relative to the floor.

According to another embodiment of the invention, in the base of the pedal device for the electronic percussion instrument, in an initial stage where the pressing part and the second pressed part comes in contact with each other, the pressing part and the second pressed part contact each other at a point or in a line.

BRIEF DESCRIPTION OF THE DRAWINGS

FIG. 1(*b*) is a top view of the pedal device.

FIG. 1(*c*) is a side view of the pedal device.

FIG. 2(*b*) is a cross-sectional view of the pedal device taken along the line IIb-IIb of FIG. 1(*b*).

FIG. 7(*b*) is a cross-sectional view of the pedal device for electronic bass drum, which uses the pedal device of the second embodiment.

FIG. 7(*c*) is a cross-sectional view of the pedal device for electronic bass drum.

DESCRIPTION OF THE EMBODIMENTS

Figure 1:
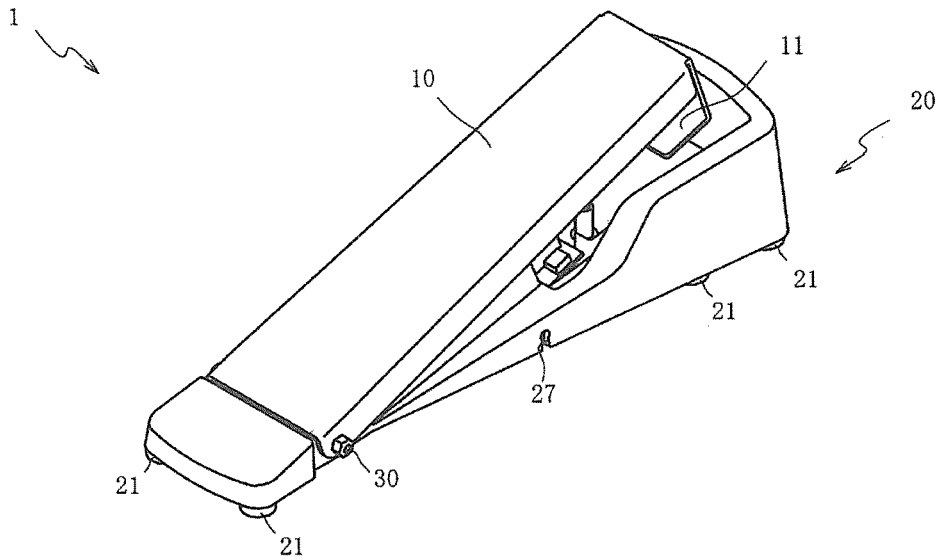
FIG. 1(*a*) is a perspective view of the pedal device according to the first embodiment.
Figure 1:
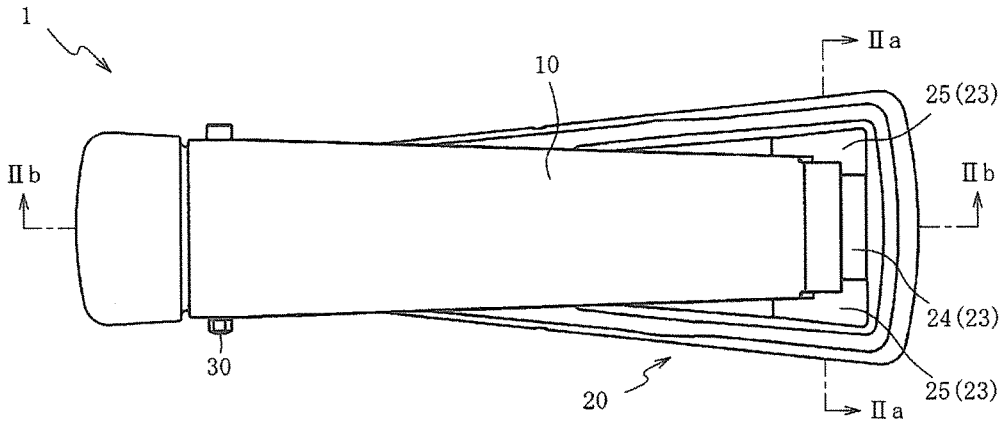
Figure 1:
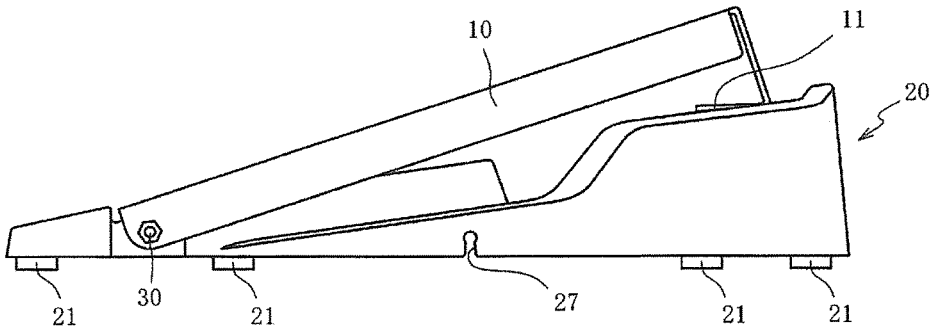

Below exemplary embodiments of the invention are described with reference to the affixed figures. First, the general structure of a pedal device 1 of the first embodiment is described with reference to FIG. 1(*a*), FIG. 1(*b*), and FIG. 1(*c*). FIG. 1(*a*) is a perspective view of the pedal device 1 according to the first embodiment of the invention. FIG. 1(*b*) is a top view of the pedal device 1. FIG. 1(*c*) is a side view of the pedal device 1.

As shown in FIG. 1(*a*) to FIG. 1(*c*), the pedal device 1 constitutes a part of a pedal device 2 for electronic hi-hat (see FIG. 3(*b*)) or a pedal device 3 for electronic bass drum (see FIG. 4(*b*)), which will be described later. The pedal device 1 mainly includes a pedal 10 and a base 20. The pedal 10 is provided to be operated by the player. The base 20 serves as a foundation. A rotation shaft 30 axially passes through one longitudinal end side of the pedal 10 (left side of FIG. 1(*c*)) and one longitudinal end side of the base 20 (left side of FIG. 1(*c*)). In this manner, one longitudinal end side of the pedal 10 is rotatably and pivotally supported by one longitudinal end side of the base 20.

The pedal device 1 is configured for alternatively disposing a first detection device 50 (see FIG. 3(*a*)) or a second detection device 60 (see FIG. 4(*a*)), which will be described later. The first detection device 50 is attached to the base 20 if the pedal device 1 is used as a component of the pedal device 2 for electronic hi-hat. Alternatively, the second detection device 60 is attached to the base 20 if the pedal device 1 is used as a component of the pedal device 3 for electronic bass drum.

Figure 2:
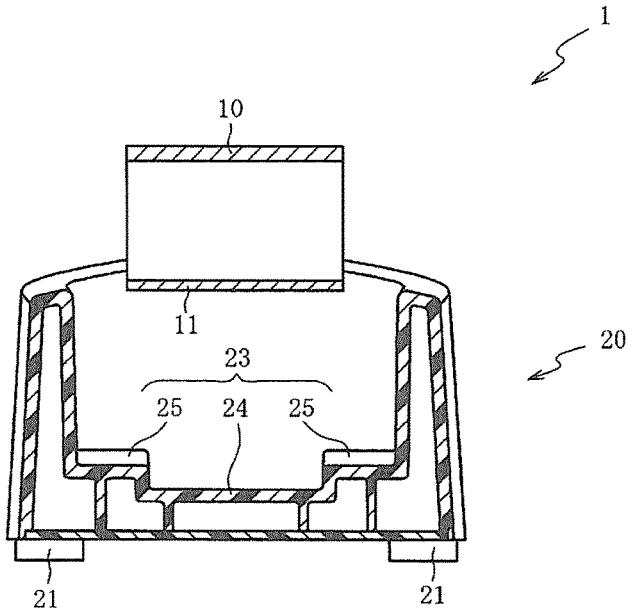
FIG. 2(*a*) is a cross-sectional view of the pedal device taken along the line IIa-IIa of FIG. 1(*b*).
Figure 2:
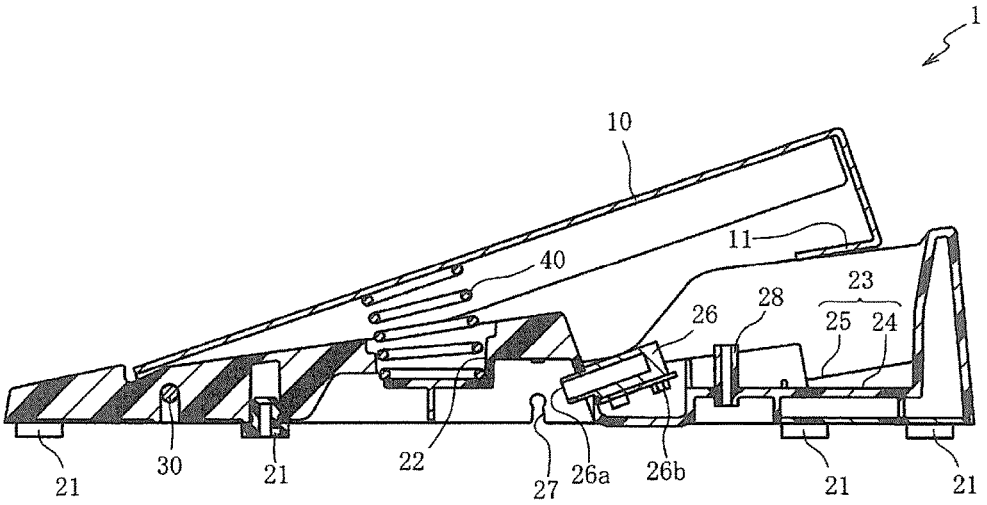

Next, the pedal device 1 is described in detail with reference to FIG. 2(*a*) and FIG. 2(*b*). FIG. 2(*a*) is a cross-sectional view of the pedal device 1 taken along the line IIa-IIa of FIG. 1(*b*). FIG. 2(*b*) is a cross-sectional view of the pedal device 1 taken along the line IIb-IIb of FIG. 1(*b*).

As shown in FIG. 2(*a*) and FIG. 2(*b*), the pedal 10 is made of one plate-shaped member formed of a steel plate of stainless steel, for example. The other longitudinal end side of the pedal 10 (right side of FIG. 2(*b*)) is bent into a substantially L shape. Under the pedal 10, a pressing part 11 that faces the base 20 is formed to extend from the other longitudinal end side toward one longitudinal end side of the pedal 10 (from the right side to the left side of FIG. 2(*b*)). An extending-direction front end side of the pressing part 11 (left side of FIG. 2(*b*)) is closer to the pedal 10 than an extending-direction base end side of the pressing part 11 (right side of FIG. 2(*b*)).

A plurality of leg parts 21 made of rubbery elastic bodies are attached to a lower surface side of the base 20. The base 20 is placed on a floor through the leg parts 21.

On an upper surface side of the base 20, a housing part 22 is recessed in a portion on the other longitudinal end side of the base 20 relative to a portion where the rotation shaft 30 axially passes through. The housing part 22 is substantially circular when viewed from above. A force applying member 40 made of a coil spring is housed in the housing part 22.

The force applying member 40 applies a force in a direction to separate the pedal 10 from the base 20. An end of the force applying member 40 is fixed to the base 20 while the other end of the force applying member 40 is fixed to the pedal 10.

Due to the force applied by the force applying member 40, the pedal 10 is maintained in a state that the other longitudinal end side of the pedal 10 floats above the base 20. When the pedal 10 is stepped to rotate, the force applying member 40 is compressed. When the stepped pedal 10 is released, the force applying member 40 applies the force in the direction (opposite to the direction along which the pedal 10 is stepped) to separate the pedal 10 from the base 20. Thus, the pedal 10 returns to the original position before the stepping.

On the upper surface side of the base 20, a support part 23 (will be described later) is formed in the portion at the other longitudinal end side (right side of FIG. 2(*a*)). The support part 23 supports the first detection device 50 (see FIG. 3(*b*)) or the second detection device 60 (see FIG. 4(*b*)). The pressing part 11 is above the support part 23.

The support part 23 includes a first portion 24 and a pair of second portions 25. The first portion 24 is located in the central portion of the support part 23 in the width direction (the left-right direction of FIG. 2(*a*)). The pair of second portions 25 is respectively located on two sides in the width direction to sandwich the first portion 24. The first portion 24 and the second portions 25 are disposed at equal distances from the rotation shaft 30.

Figure 3:
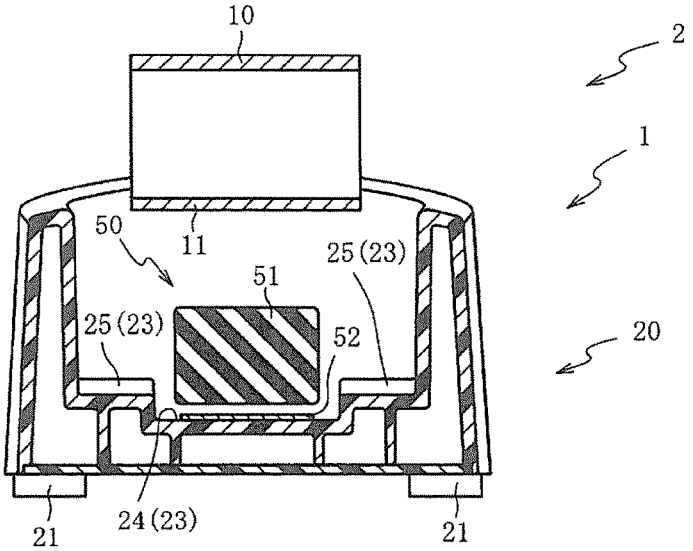
FIG. 3(*a*) and FIG. 3(*b*) are cross-sectional views of the pedal device for electronic hi-hat.
Figure 3:
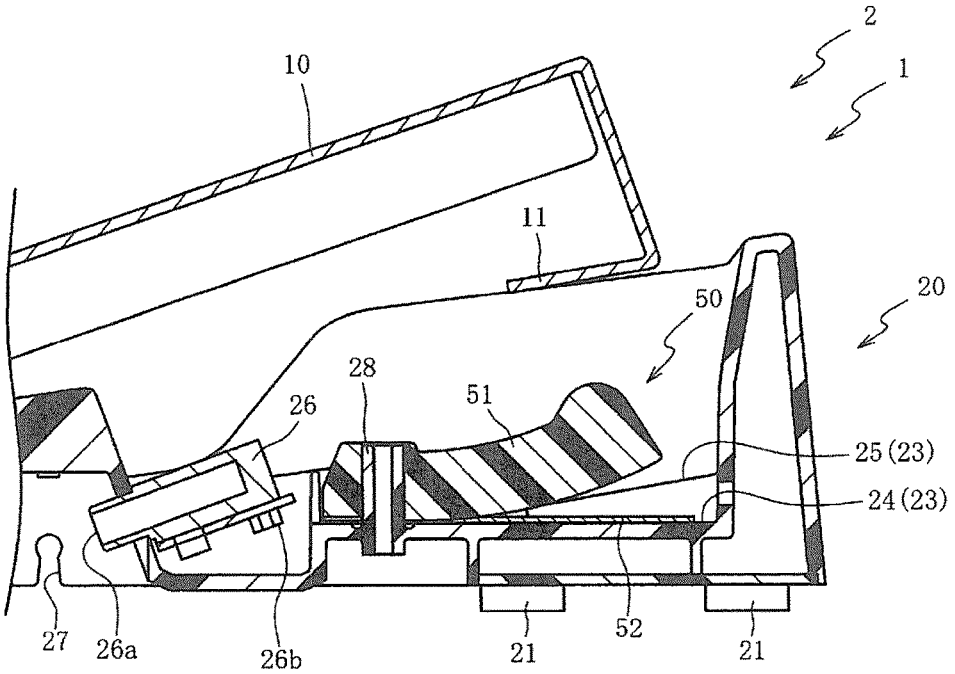

The first portion 24 is a portion that supports the first detection device 50 (see FIG. 3(*a*)). The second portions 25 are portions that support the second detection device 60 (see FIG. 4(*a*)). The second portions 25 are formed above the first portion 24. That is, the second portions 25 are closer to the pressing part 11 than the first portion 24.

When the base 20 is placed on the floor, the first portion 24 is parallel to the floor. The second portions 25 incline upward relative to the floor from one longitudinal end side to the other longitudinal end side of the base 20 (from the left side to the right side of FIG. 2(*b*)).

A jack 26 is disposed to penetrate a portion between the housing part 22 and the support part 23 of the base 20. The jack 26 is a portion to which a connection cable (not shown) is connected. The connection cable electrically connects the pedal device 1 with an external sound source device (not shown). The jack 26 includes an insertion port 26*a* and a connection part 26*b*. The insertion port 26*a* protrudes downward obliquely from the base 20. The connection part 26*b* is formed at a position that protrudes upward obliquely from the base 20.

The insertion port 26*a* is a portion where a plug (not shown) disposed on the connection cable is connected. The connection part 26*b* is a portion where a connection cord (not shown) is connected. The connection cord (not shown) electrically connects the first detection device 50 or the second detection device 60 with the jack 26.

A guide part 27 is recessed on the lower surface of the base 20. The guide part 27 extends in the width direction of the base 20 (perpendicular to the paper surface of FIG. 2(*b*). The guide part 27 is a portion for guiding the connection cable. The guide part 27 guides the connection cable in either direction to one side or the other side of the base 20 in the width direction. Therefore, arrangement of the connection cable from the pedal device 1 to the sound source device is simplified.

Here, for the pedal device used in an electronic percussion instrument that simulates an acoustic hi-hat or bass drum, preferably the pedal has appropriate inertia, so as to make the feeling of operating the pedal device similar to the feeling of operating real acoustic hi-hat or bass drum.

Regarding this, the conventional pedal is made of a resin material or aluminum, which is light in weight and applies small inertia to the pedal. In order to give the pedal made of such light materials a moderate inertia, a member may be added to serve as a weight to improve the operational feeling the player feels during the playing. However, it would increase the production costs of the pedal.

In contrast thereto, the pedal 10 of the pedal device 1 is made of stainless steel for increasing the dead weight of the pedal 10. Moreover, the pressing part 11 is formed integrally with the pedal 10 and disposed at a position away from the rotation shaft 30 (the other longitudinal end side of the pedal 10). By doing so, the pedal 10 is provided with moderate inertia.

In addition, the pedal 10 and the pressing part 11 are formed integrally by bending one plate-shaped member. Therefore, the structure of the pedal 10 and the pressing part 11 is simplified.

As described above, the pedal 10 and the pressing part 11 are formed by bending one plate-shaped member that is made of stainless steel. Thus, the operational feeling the player feels when playing the electronic percussion instrument using the pedal device 1 is improved, and the production costs of the pedal device 1 are reduced.

Hereinafter, the pedal device 2 for electronic hi-hat, which uses the pedal device 1, is described with reference to FIG. 3(*a*) and FIG. 3(*b*). FIG. 3(*a*) and FIG. 3(*b*) are cross-sectional views of the pedal device 2 for electronic hi-hat. FIG. 3(*a*) and FIG. 3(*b*) illustrate a state where the first detection device 50 is attached to the base 20. The cross-sectional view of FIG. 3(*a*) corresponds to FIG. 2(*a*). The cross-sectional view of FIG. 3(*b*) corresponds to FIG. 2(*b*).

As shown in FIG. 3(*a*) and FIG. 3(*b*), the pedal device 2 for electronic hi-hat is an electronic percussion instrument that simulates a pedal device for acoustic hi-hat. The first detection device 50 is disposed on the first portion 24. The first detection device 50 and the jack 26 are electrically connected through the connection cord (not shown). The pedal device 2 for electronic hi-hat detects the rotation of the pedal 10 by the first detection device 50. Further, a detection signal that corresponds to the rotation angle of the pedal 10 is sent to the external sound source device (not shown) via the connection cable (not shown).

The first detection device 50 includes a first pressed part 51 and a first sensor 52. The first pressed part 51 is made of a curved rubbery elastic body. The first sensor 52 detects whether the first pressed part 51 is pressed by the pressing part 11.

The first sensor 52 is a sheet-shaped contact sensor. The first sensor 52 is interposed between the first pressed part 51 and the first portion 24. One longitudinal end side of the first pressed part 51 and one longitudinal end side of the first sensor 52 (left side of FIG. 3(*b*)) are fixed to a protrusion part 28 that protrudes from the upper surface of the base 20. The other longitudinal end side of the first pressed part 51 (right side of FIG. 3(*b*)) is maintained floating above the first sensor 52.

In the pedal device 2 for electronic hi-hat, when the pedal 10 is stepped and rotates, the pressing part 11 is displaced with the rotation of the pedal 10. Then, the displaced pressing part 11 presses the first pressed part 51, and the pressed first pressed part 51 is elastically deformed. When the first sensor 52 is pressed by the elastically deformed first pressed part 51, the first sensor 52 determines that the pedal 10 has rotated. The first sensor 52 also detects the rotation angle of the pedal 10 based on the range that the first sensor 52 is pressed (see FIG. 5(*a*) and FIG. 5(*b*)).

Hereinafter, the pedal device 3 for electronic bass drum, which uses the pedal device 1, is described with reference to FIG. 4(*a*) and FIG. 4(*b*). FIG. 4(*a*) and FIG. 4(*b*) are cross-sectional views of the pedal device 3 for electronic bass drum. FIG. 4(*a*) and FIG. 4(*b*) illustrate a state where the second detection device 60 is attached to the base 20. The cross-sectional view of FIG. 4(*a*) corresponds to FIG. 2(*a*). The cross-sectional view of FIG. 4(*b*) corresponds to FIG. 2(*b*).

Figure 4:
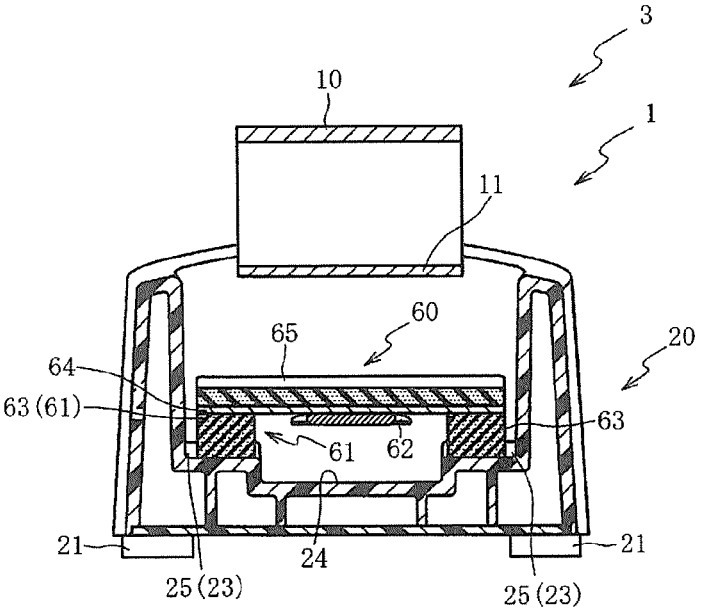
FIG. 4(*a*) and FIG. 4(*b*) are cross-sectional views of the pedal device for electronic bass drum.
Figure 4:
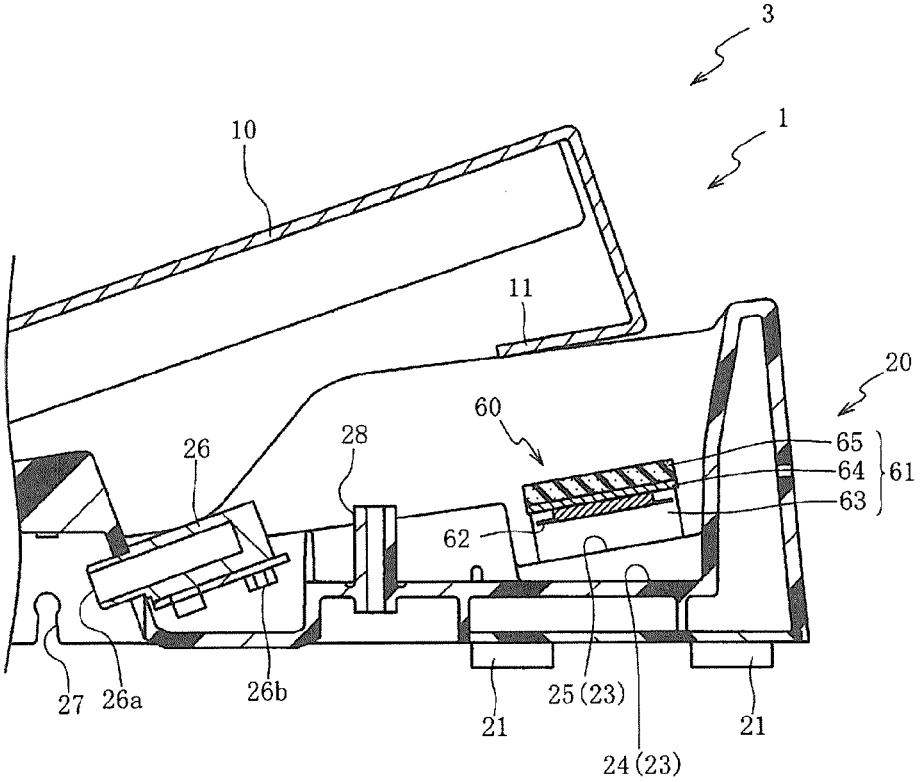

As shown in FIG. 4(*a*) and FIG. 4(*b*), the pedal device 3 for electronic bass drum is an electronic percussion instrument that simulates a pedal device for acoustic bass drum. The second detection device 60 is disposed on the second portions 25. The second detection device 60 and the jack 26 are electrically connected through the connection cord (not shown). The pedal device 3 for electronic bass drum detects the rotation of the pedal 10 by the second detection device 60. Further, a detection signal that corresponds to the rotation angle of the pedal 10 is sent to the external sound source device (not shown) via the connection cable (not shown).

The second detection device 60 includes a second pressed part 61 and a second sensor 62. The second pressed part 61 is disposed to bridge the second portions 25. The second sensor 62 is attached to the second pressed part 61.

The second pressed part 61 includes a pair of first cushions 63, a plate 64, and a second cushion 65. The pair of first cushions 63 is supported by the second portions 25. The plate 64 is disposed to bridge the pair of first cushions 63. The second cushion 65 is disposed to cover an upper surface side of the plate 64.

The first cushion 63 is a rectangular parallelepiped member made of a foam material. The plate 64 is formed of one steel plate. The second cushion 65 is a plate-shaped member made of a foam material that is harder than the first cushion 63.

The second sensor 62 is a piezoelectric sensor. The second sensor 62 is affixed to a lower surface of the plate 64 through a double-sided tape.

In a state where the second detection device 60 bridges the second portions 25, the second sensor 62 is disposed at a position facing the first portion 24. Two sides of the plate 64 in the width direction (the left-right direction of FIG. 4(*a*)), which sandwich the position where the second sensor 62 is affixed, are supported by the second portions 25 through the pair of first cushions 63. The second pressed part 61 keeps the second sensor 62 apart from the first portion 24.

In the state where the base 20 is placed on the floor, the upper surface of the second cushion 65 inclines upward from one longitudinal end side toward the other longitudinal end side of the base 20 (from the left side to the right side of FIG. 4(*b*)).

In the pedal device 3 for electronic bass drum, when the pedal 10 is stepped and rotates, the pressing part 11 is displaced with the rotation of the pedal 10. Then, the displaced pressing part 11 comes into contact with the second pressed part 61, and the second pressed part 61 vibrates due to the contact. The second sensor 62 detects the vibration of the second pressed part 61 and thereby determines that the pedal 10 has rotated. The second sensor 62 also detects the rotation angle of the pedal 10 based on the detected vibration.

Regarding the second detection device 60, the plate 64 is made of a plate-shaped steel plate, and the second sensor 62 is attached to the plate 64. By doing so, when the pressing part 11 contacts the second pressed part 61, the plate 64 can be vibrated easily. As a result, the vibration of the plate 64 can be detected by the second sensor 62, and the accuracy of detecting the rotation of the pedal 10 is increased.

As described above, the pedal device 1 is configured for disposing the first detection device 50 or the second detection device 60 alternatively on the support part 23. Thus, the pedal device can be used as a component common to the pedal device 2 for electronic hi-hat (see FIG. 3(*a*) and FIG. 3(*b*)) and the pedal device 3 for electronic bass drum.

In addition, when the pedal device 1 is used as a component of the pedal device 2 for electronic hi-hat, the first detection device 50 is disposed on the first portion 24 (see FIG. 3(*a*) and FIG. 3(*b*)). When the pedal device 1 is used as a component of the pedal device 3 for electronic bass drum, the second detection device 60 is disposed on the second portions 25 (see FIG. 4(*a*) and FIG. 4(*b*)). The first pressed part 51 or the second pressed part 61 can be disposed on a displacement trajectory of the pressing part 11 that is displaced as the pedal 10 rotates. Thus, the process of attaching the first detection device 50 or the second detection device 60 to the pedal device 1 is simplified.

Here, one longitudinal end side of the pedal 10 is rotatably and pivotally supported by the base 20, and the pressing part 11 is formed on the other longitudinal end side of the pedal 10. With this configuration, the pressing part 11 is away from the rotation shaft 30 to ensure a large displacement range of the pressing part 11 when the pedal 10 rotates. Furthermore, the first detection device 50 disposed on the first portion 24 and the second detection device 60 disposed on the second portions 25 are both on the displacement trajectory of the pressing part 11. Thus, the pedal device 2 for electronic hi-hat and the pedal device 3 for electronic bass drum can both detect the rotation of the pedal accurately.

The second portion 25 is formed at a position where a distance from the rotation shaft 30 of the base 20 to the second portions 25 is equal to a distance from the rotation shaft 30 to the first portion 24. Therefore, the structure of the second detection device 60 for disposing the second pressed part 61 on the displacement trajectory of the pressing part 11 is simplified. The production costs of the whole pedal device 3 for electronic bass drum are reduced.

Moreover, the pair of second portions 25 is respectively disposed on two sides in the width direction (two sides in the left-right direction of FIG. 4(*a*)) to sandwich the first portion 24. A distance between one second portion 25 and the rotation shaft 30 is equal to a distance between the other second portion 25 and the rotation shaft 30. When the second pressed part 61 is stepped, the pressure from the pressing part 11 can be evenly dispersed onto the first cushions 63 easily. Hence, it is possible to prevent one of the first cushions 63 from wearing soon due to unbalanced pressure on the first cushion 63.

Furthermore, the first detection device 50 or the second detection device 60 can be disposed on the support part 23 alternatively. By disposing the jack 26 close to the support part 23, the arrangement of the connection cord (not shown) that connects the first sensor 52 or the second sensor 62 with the jack 26 can be simplified.

Figure 5:
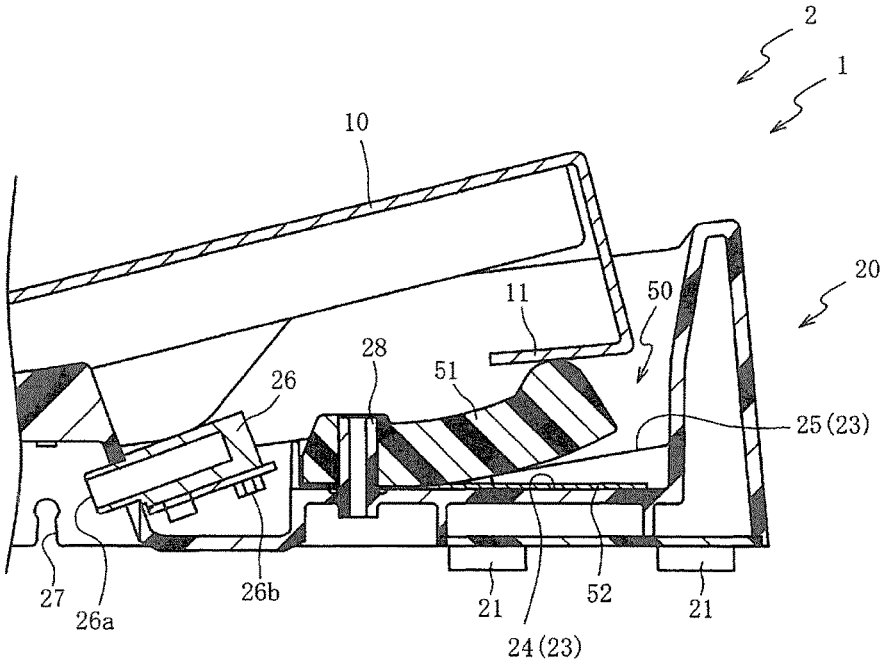
FIG. 5(*a*) and FIG. 5(*b*) are partially enlarged cross-sectional views of a portion of the pedal device for electronic hi-hat.
Figure 5:
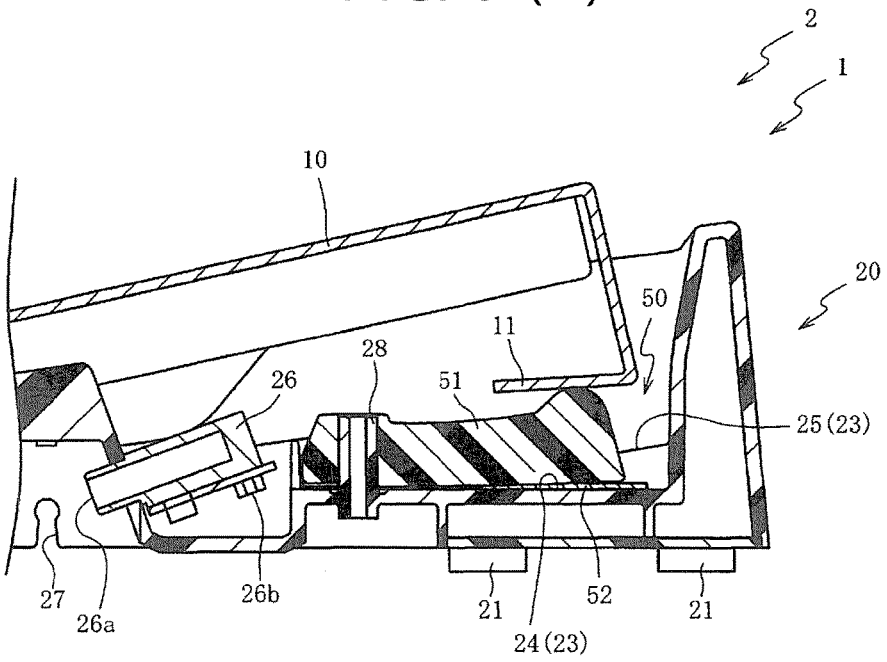

Below, a method for detecting the rotation of the pedal 10 by the first detection device 50 is described with reference to FIG. 5(*a*) and FIG. 5(*b*). FIG. 5(*a*) and FIG. 5(*b*) are partially enlarged cross-sectional views of a portion of the pedal device 2 for electronic hi-hat. FIG. 5(*a*) and FIG. 5(*b*) illustrate a state where the first detection device 50 is attached to the pedal device 1. The cross-sectional views of FIG. 5(*a*) and FIG. 5(*b*) correspond to FIG. 2(*b*). FIG. 5(*a*) illustrates a state where the pedal 10 is stepped to cause contact between the pressing part 11 and the first pressed part 51. FIG. 5(*b*) illustrates a state where the pedal 10 is further stepped down from the state of FIG. 5(*a*) and the rotation of the pedal 10 is restricted.

As shown in FIG. 5(*a*), when the pedal 10 of the pedal device 2 for electronic hi-hat is stepped and rotates a predetermined angle, the pressing part 11 contacts the first pressed part 51.

As shown in FIG. 5(*b*), when the pedal 10 of the pedal device 2 for electronic hi-hat is further stepped down from the state in contact with the first pressed part 51, the first pressed part 51 is pressed and elastically deformed by the pressing part 11 displaced with the rotation of the pedal 10. When the pedal 10 is further stepped to compress the first pressed part 51 maximally between the pressing part 11 and the first portion 24, the rotation of the pedal 10 is restricted.

In the state where the rotation of the pedal 10 is restricted, the pressing part 11 is above the second portions 25. Thus, collision between the pressing part 11 and the second portions 25 is prevented. Consequently, abrupt restriction of the rotation of the pedal 10 caused by collision between the pressing part 11 and the second portions 25 can be avoided.

As a result, the width dimension of the pressing part 11 (dimension in the direction perpendicular to the paper surface of FIG. 5(*b*)) can be increased and two side portions of the pressing part 11 in the width direction can extend to positions facing the second portions 25. Therefore, the second pressed part 61 can be compressed efficiently between the pressing part 11 and the second portions 25 (see FIG. 6(*c*)) in the pedal device 3 for electronic bass drum.

Regarding the pedal device 2 for electronic hi-hat, the pressing part 11 comes in contact with the first pressed part 51 when the pedal 10 is rotated to a position at an inclination angle of about 14 degrees relative to the floor. When the pedal 10 is rotated to a position at an inclination angle of about 12.5 degrees relative to the floor, the rotation of the pedal 10 is restricted.

Figure 6:
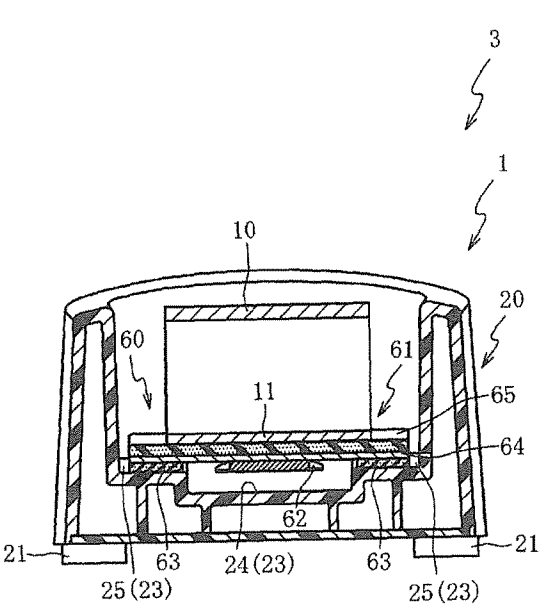
FIGS. 6(*a*)~6(*c*) are partially enlarged cross-sectional views of a portion of the pedal device for electronic bass drum.
Figure 6:
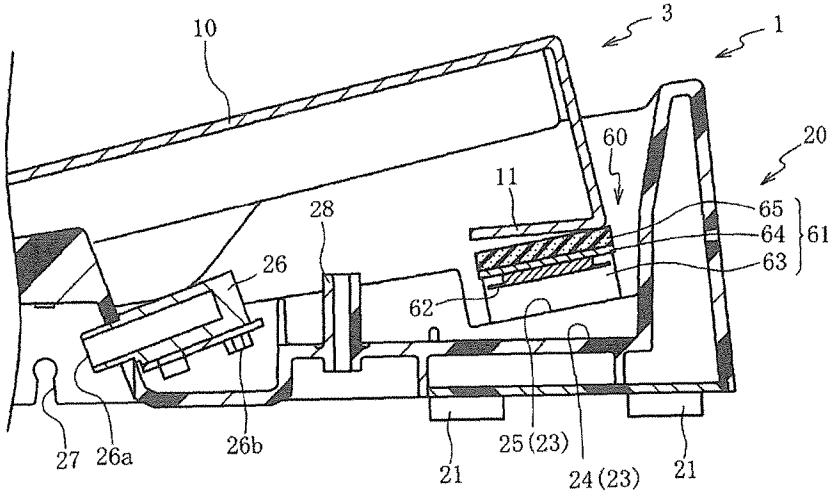
Figure 6:
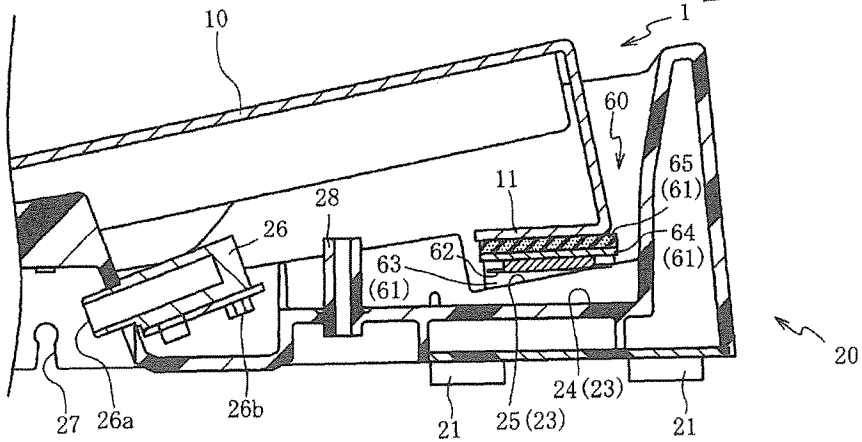

Next, a method for detecting the rotation of the pedal 10 by the second detection device 60 is described with reference to FIG. 6(*a*), FIG. 6(*b*), and FIG. 6(*c*). FIG. 6(*a*), FIG. 6(*b*), and FIG. 6(*c*) are partially enlarged cross-sectional views of a portion of the pedal device 3 for electronic bass drum. FIG. 6(*a*), FIG. 6(*b*), and FIG. 6(*c*) illustrate a state where the second detection device 60 is attached to the pedal device 1. The cross-sectional views of FIG. 6(*a*) and FIG. 6(*b*) correspond to FIG. 2(*b*). The cross-sectional view of FIG. 6(*c*) corresponds to FIG. 2(*a*). FIG. 6(*a*) illustrates a state where the pedal 10 is stepped to cause contact between the pressing part 11 and the second pressed part 61. FIG. 6(*b*) and FIG. 6(*c*) illustrate a state where the pedal 10 is further stepped down from the state of FIG. 6(*a*) and the rotation of the pedal 10 is restricted.

As shown in FIG. 6(*a*), when the pedal 10 of the pedal device 3 for electronic bass drum is stepped and rotates a predetermined angle, the pressing part 11 contacts the second cushion 65 of the second pressed part 61.

At the moment, the upper surface of the second cushion 65 inclines upward from one longitudinal end side toward the other longitudinal end side of the base 20 (from the left side to the right side of FIG. 6(*a*)). In the state of FIG. 6(*a*), the inclination angle of the upper surface of the pedal 10 (the portion stepped by the player) relative to the floor is substantially equal to the inclination angle of the second cushion 65 relative to the floor. In other words, when the pressing part 11 comes into contact with the upper surface of the second cushion 65, a tangential direction of the displacement trajectory of the pressing part 11 displaced with the rotation of the pedal 10 is substantially perpendicular to the upper surface of the second cushion 65.

Therefore, if the pedal 10 is further stepped down from the state where the pressing part 11 is in contact with the second pressed part 61 (the state of FIG. 6(*a*)), the first cushions 63 and the second cushion 65 can be easily compressed in the thickness direction thereof.

If the direction of the pressing force from the pressing part 11 deviates greatly from the thickness direction of the first cushions 63 and the second cushion 65, a large shearing force may be applied on the first cushions 63 or the second cushion 65 and damage the second pressed part 61 soon.

In contrast to the above, the direction of the upper surface of the pedal 10 and the direction of the upper surface of the second cushion 65 in the pedal device 3 for electronic bass drum are substantially parallel to each other when the pressing part 11 comes in contact with the second cushion 65. Thus, the pressing force from the pressing part 11 is applied on the second pressed part 61 along the thickness direction of the first cushions 63 and the second cushion 65. As a result, the shearing force applied on the first cushions 63 and the second cushion 65 is reduced. Wear of the second cushion 65 resulting from friction between the second cushion 65 and the pressing part 11 is reduced as well. Furthermore, the pressing force from the pressing part 11 can be transferred to the second pressed part 61 efficiently. Therefore, the rotation of the pedal 10 can be accurately detected by the second sensor 62.

The upper surface of the second cushion 65 has a flat plate shape. The direction of the upper surface of the second cushion 65 is substantially consistent with the direction of the second portions 25. Since the direction of the upper surface of the second cushion 65 inclines relative to the floor, the shape of the second detection device 60 can be simplified. Consequently, the production costs of the pedal device 3 for electronic bass drum can be reduced.

By making the direction of the second portions 25 substantially consistent with the direction of the upper surface of the second cushion 65, the pressing force from the pressing part 11 is applied in a direction substantially perpendicular to the second portions 25. Thus, the first cushions 63 and the second cushions 65 can be compressed efficiently in the thickness direction thereof between the pressing part 11 and the second portions 25. The shearing force applied on the first cushions 63 and the second cushion 65 can be reduced.

In order to compress the first cushions 63 and the second cushion 65 in the thickness direction thereof more efficiently, it is preferable to form the pressing part 11 substantially parallel to the upper surface of the pedal 10. By doing so, the entire surface of the pressing part 11 can be in contact with the upper surface of the second cushion 65 in the initial stage of the contact of the pressing part 11 and the second pressed part 61. In this situation, however, the contact area between the pressing part 11 and the second cushion 65 increases when the pressing part 11 collides with the second cushion 65. As a result, the impact sound of the collision becomes louder.

Regarding this, in the pedal device 3 for electronic bass drum, the direction of the lower surface of the pressing part 11 and the direction of the upper surface of the second cushion 65 are inconsistent with each other in the initial stage of the contact of the pressing part 11 and the second cushion 65. Therefore, the pressing part 11 contacts the second cushion 65 first on the other longitudinal end side (right side of FIG. 6(*a*)). Then, as the pedal 10 is stepped further, the contact area between the pressing part 11 and the upper surface of the second cushion 65 increases gradually.

As described above, in the pedal device 3 for electronic bass drum, the pressing part 11 contacts the second cushion 65 in a line in the initial stage of the contact of the pressing part 11 and the second cushion 65. The contact area between the pressing part 11 and the second cushion 65 can be reduced in comparison with the contact area between the entire surface of the pressing part 11 and the second cushion 65. Hence, the impact sound that occurs when the pressing part 11 collides with the second cushion 65 decreases.

Furthermore, the contact area between the pressing part 11 and the second cushion 65 increases with the rotation angle of the pedal 10. Thus, it is possible to prevent the second cushion 65 from wearing soon due to the partial pressing force the pressing part 11 applies on the second cushion 65 (see FIG. 6(*b*)).

Provided that the extending-direction front end side of the pressing part 11 (one longitudinal end side of the pedal 10; left side of FIG. 6(*a*)) is farther away from the pedal 10 than the extending-direction base end side of the pressing part 11

(the other longitudinal end side of the pedal 10; right side of FIG. 6(*a*)), the pressing part 11 first contacts the second cushion 65 at the extending-direction front end side. In this situation, the upper surface of the second cushion 65 is partially pressed by the extending-direction front end side of the pressing part 11. For this reason, the second cushion 65 may be damaged soon. Moreover, a load is applied on the extending-direction front end side of the pressing part 11 and pushes the extending-direction front end side toward the pedal 10. Thus, the pressing part 11 may be deformed easily. When the pressing part 11 is deformed, the rotation angle for achieving contact between the pressing part 11 and the second pressed part 61 also changes, which causes a problem.

Regarding this, in this embodiment, the extending-direction front end side of the pressing part 11 is formed closer to the pedal 10 than the extending-direction base end side of the pressing part 11. Thus, early damage of the second pressed part 61 and deformation of the pressing part 11 can be suppressed.

The second cushion 65 of the second pressed part 61 is made of a foam material harder than the first cushions 63. Therefore, the second cushion 65 has improved durability against the impact of collision of the pressing part 11. In addition, the impact caused by collision of the pressing part 11 can be buffered by the first cushions 63.

The elastic material used to form the first cushions 63 or the second cushion 65 may be a foam material (e.g. urethane sponge), an elastic body (e.g. synthetic rubber and silicone rubber), an elastic resin (e.g. elastomer), or a felt or carpet material, for example. A spring may serve as the first cushion 63. Moreover, a sheet-like, cloth-like, or mesh material may be affixed to the surface of the second cushion 65.

As shown in FIG. 6(*b*) and FIG. 6(*c*), when the pedal 10 is further stepped down from the state where the pressing part 11 is in contact with the second cushion 65, the first cushions 63 and the second cushion 65 are clamped and compressed between the pressing part 11 and the second portions 25. When the first cushions 63 and the second cushion 65 are compressed maximally, the rotation of the pedal 10 is restricted.

The second portions 25 are closer to the pressing part 11 than the first portion 24. Thus, the plate 64 is restricted from displacing below the second portions 25. With this configuration, a space is formed between the plate 64 and the first portion 24. The second sensor 62 is accommodated in the space. As a result, contact between the second sensor 62 and the first portion 24 can be avoided.

Even if the pedal 10 is stepped maximally, the second sensor 62 attached to the plate 64 can remain separated from the first portion 24 and not in contact with the first portion 24. Thus, damage of the second sensor 62 caused by contact with the first portion 24 can be prevented.

As described above, the second portions 25 also function as a restricting means for restricting the rotation angle of the pedal 10. In comparison with using the second detection device 60 as the restricting means, the configuration of this embodiment simplifies the structure for preventing contact between the second sensor 62 and the first portion 24. In other words, the production costs of the whole pedal device 3 for electronic bass drum can be reduced.

Furthermore, the second sensor 62 is attached to the plate 64 right below where the second cushion 65 is pressed by the pressing part 11. Thus, the vibration of the second pressed part 61 that occurs when the pressing part 11 presses the second pressed part 61 can be detected easily. The accuracy of the second sensor 62 detecting the rotation of the pedal 10 is increased.

In the pedal device 3 for electronic bass drum, the pressing part 11 comes in contact with the second pressed part 61 when the inclination angle of the pedal 10 relative to the floor is about 13 degrees. The rotation of the pedal 10 is restricted when the inclination angle of the pedal 10 relative to the floor is about 10 degrees.

The inclination angle of the pedal 10 of the pedal device 3 for electronic bass drum when the pressing part 11 comes in contact with the second pressed part 61 differs from the inclination angle of the pedal 10 of the pedal device 2 for electronic hi-hat (see FIG. 5(*b*)) when the pressing part comes in contact with the first pressed part 51 (see FIG. 5(*b*)). In addition, when the rotation of the pedal 10 is restricted, the inclination angle of the pedal 10 of the pedal device 3 for electronic bass drum differs from the inclination angle of the pedal 10 of the pedal device 2 for electronic hi-hat.

That is, for the situation of using the pedal device 1 as the pedal device 2 for electronic hi-hat and the situation of using the pedal device 1 as the pedal device 3 for electronic bass drum, the rotation angle of the pedal 10 required for achieving contact between the pressing part 11 and the first detection device 50 or the second detection device 60, or the rotation range of the pedal 10 can be set separately.

Thereby, when the pedal device 1 is used as a component of the pedal device 2 for electronic hi-hat, the feeling of operating the pedal 10 can be made similar to the feeling of operating the pedal device for an acoustic hi-hat. Likewise, when the pedal device 1 is used as a component of the pedal device 3 for electronic bass drum, the feeling of operating the pedal 10 can be made similar to the feeling of operating the pedal device for an acoustic bass drum. The pedal device 1 used in the pedal device 3 for electronic bass drum and the pedal device 1 used in the pedal device 2 for electronic hi-hat can share the same parts to achieve part commonality, and the operational feeling the player feels when playing with the pedal device 3 for electronic bass drum or the pedal device 2 for electronic hi-hat can be enhanced.

As described above, the pedal device 1 can be used as a component of the pedal device 2 for electronic hi-hat and the pedal device 3 for electronic bass drum. In addition, no matter the pedal device 1 is used in the pedal device 2 for electronic hi-hat or the pedal device 3 for electronic bass drum, the rotation of the pedal 10 can be detected accurately.

Hereinafter, the second embodiment is described with reference to FIG. 7(*a*) and FIG. 7(*b*). In the first embodiment, the second portions 25 are located above the first portion 24. In contrast thereto, in the second embodiment, the second portions 225 are located below the first portion 24. The same reference numerals are assigned to denote parts the same as those in the first embodiment. Thus, detailed descriptions thereof are omitted hereinafter.

Figure 7:
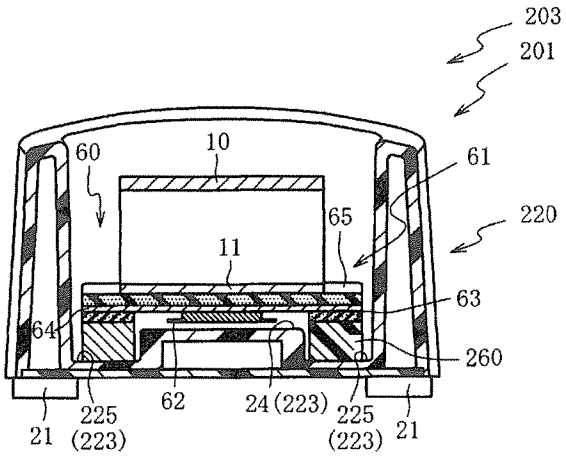
FIG. 7(*a*) is a cross-sectional view of the pedal device for electronic hi-hat, which uses the pedal device of the second embodiment.
Figure 7:
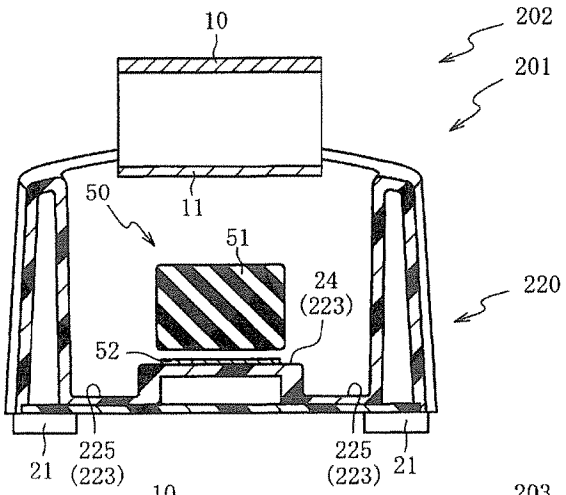
Figure 7:
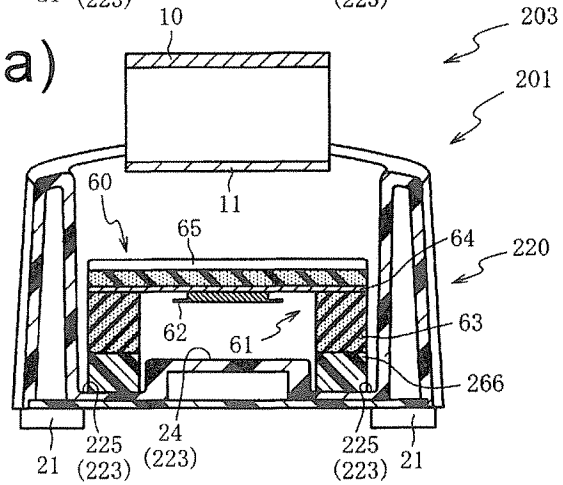

FIG. 7(*a*) is a cross-sectional view of a pedal device 202 for electronic hi-hat, which uses a pedal device 201 of the second embodiment. FIG. 7(*b*) is a cross-sectional view of a pedal device 203 for electronic bass drum, which uses the pedal device 201. FIG. 7(*c*) is a cross-sectional view of the pedal device 203 for electronic bass drum. The cross-sectional views of FIG. 7(*a*) and FIG. 7(*b*) correspond to FIG. 2(*a*). The cross-sectional view of FIG. 7(*c*) corresponds to FIG. 6(*c*). FIG. 7(*c*) illustrates a state where the pedal 10 is stepped and the rotation of the pedal 10 is restricted.

As shown in FIG. 7(*a*), a support part 223 includes the first portion 24 and the second portions 225. The second portions 225 are located on two sides of the first portion 24 in the width direction (two sides of the left-right direction of FIG. 7(*a*)). The second portions 225 are formed below the first portion 24.

When the pedal device 201 is used as a component of the pedal device 202 for electronic hi-hat, the first pressed part 51 is supported by the first portion 24. When the first pressed part 51 clamped and pressed by the first portion 24 and the pressing part 11 is compressed maximally, the rotation of the pedal 10 is restricted.

In a base 220, the second portions 225 are located below the first portion 24. Thus, it is possible to prevent the pressing part 11 from contacting the second portions 225. As a result, the width dimension of the pressing part 11 (the dimension in the left-right direction of FIG. 7(*a*)) can be increased and two side portions of the pressing part 11 in the width direction can extend to positions facing the second portions 225. Hence, the second detection device 60 can be compressed efficiently between the pressing part 11 and the second portions 225.

As shown in FIG. 7(*b*), when the pedal device 201 is used as a component of the pedal device 203 for electronic bass drum, a restricting part 266 is connected with a lower end of the first cushion 63. Moreover, the second detection device 60 is disposed to bridge the second portions 225 through the restricting parts 266.

The restricting part 266 is provided for restricting the rotation angle of the pedal 10. The restricting part 266 is made of a hard resin material. In addition, the height of the restricting part 266 (the dimension in the vertical direction of FIG. 7(*b*)) is greater than a height difference between the first portion 24 and the second portion 225. Thus, the upper surface of the restricting part 266 to which the first cushion 63 is connected is above the first portion 24.

In this embodiment, when the base 220 is placed on the floor, the second portions 225 are substantially parallel to the floor. The upper surface of the restricting part 266 (the surface where the first cushion 63 is connected) inclines relative to the lower surface of the restricting part 266 (the surface supported by the second portion 225). The restricting part 266 is supported by the second portion 225 in a state that the upper surface of the restricting part 266 inclines upward from one longitudinal end side to the other longitudinal end side of the base 220 (from the near side to the far side of the paper surface of FIG. 7(*b*)). Consequently, the upper surface of the second cushion 65 of the second detection device 60 bridged on the second portions 225 through the restricting part 266 also inclines relative to the floor.

As shown in FIG. 7(*c*), when the pedal 10 is further stepped down from the state where the pressing part 11 is in contact with the second cushion 65, the first cushions 63 are compressed between the plate 64 and the restricting parts 266. When the first cushions 63 are compressed maximally, the rotation angle of the pedal 10 is restricted. At this moment, displacement of the plate 64 is restricted by the restricting parts 266, so as to prevent contact between the second sensor 62 and the first portion 24. As a result, damage of the second sensor 62 can be avoided.

The above illustrates the invention on the basis of the exemplary embodiments. However, it should be understood that the invention is not limited to any of the exemplary embodiments, and various modifications or alterations may be made without departing from the spirit of the invention.

For instance, in the pedal device 2, 202 for electronic hi-hat or the pedal device 3, 203 for electronic bass drum of the above embodiments, the inclination angles of the pedal 10 relative to the floor when the pressing part 11 comes in contact with the first detection device 50 or the second detection device 60 are given as examples. The inclination angles can certainly be other values. The aforementioned values of the inclination angles of the pedal 10 relative to the floor when the rotation is restricted are examples as well. The inclination angles can certainly be other values.

According to the above embodiments, in the state where the base 20, 220 is placed on the floor, the upper surface of the second cushion 65 inclines relative to the floor. However, the upper surface of the second cushion 65 may be substantially parallel to the floor.

In the above embodiments, the inclination angles of the upper surface of the second cushion 65 and the second portions 25 relative to the floor are substantially equal to the inclination angle of the pedal 10 relative to the floor when the second pressed part 61 supported by the second portions 25 is in contact with the pressing part 11. However, it is sufficient if the inclination angles of the upper surface of the second cushion 65 and the second portions 25 relative to the floor are equal to the inclination angle of the pedal 10 relative to the floor at any time between the initial contact of the pressing part 11 and the second pressed part 61 and the restriction of the rotation of the pedal 10.

Moreover, according to the above embodiments, in the state where the base 20, 220 is placed on the floor, the upper surface of the second portion 25 or the restricting part 266 inclines upward relative to the floor from one longitudinal end side toward the other longitudinal end side of the base 20, 220. However, the upper surface of the second portion 25 or the restricting part 266 may be substantially parallel to the floor.

In the above embodiments, the second portion 25, 225 is formed at a position where the distance from the second portion 25, 225 to the rotation shaft 30 is equal to the distance from the first portion 24 to the rotation shaft 30. However, in the case that the second portion is formed at least around the first portion 24 and the second detection device 60 bridges the second portion, other configurations may be adopted as long as the second sensor 62 can be supported to be separated from the first portion 24 and not contact the first portion 24.

In the above embodiments, the second cushion 65 is made of a material that is harder than the first cushion 63. However, the second cushion 65 may have the same elasticity as the first cushion 63. The second cushion 65 may also be made of a soft material that is softer than the first cushion 63. In this way, the impact sound generated when the pressing part 11 collides with the second cushion 65 can be reduced. In addition, cloth or the like that has a muffling function may be disposed to cover the upper surface of the second cushion 65, so as to reduce the impact sound caused by collision of the pressing part 11 and the second cushion 65.

According to the above embodiments, in the state where the base 20, 220 is placed on the floor, the direction of the lower surface of the pressing part 11 and the direction of the upper surface of the second cushion 65 are inconsistent with each other in the initial stage of the contact of the pressing part 11 and the second pressed part 61. Thus, the pressing part 11 is in contact with the upper surface of the second cushion 65 in a line. However, the pressing part may be formed to contact the second cushion 65 at a point. Besides, the direction of the lower surface of the pressing part and the direction of the upper surface of the second cushion 65 may be consistent with each other, such that the lower surface of the pressing part and the upper surface of the second cushion 65 are in surface contact. If the pressing part contacts the second cushion 65 at a point, the impact sound generated when the pressing part collides with the second cushion can be reduced. If the pressing part and the second cushion are in surface contact, vibration of the second pressed part 61 can be ensured for the second sensor 62 to accurately detect the rotation of the pedal 10.

According to the above embodiments, the upper surface of the second cushion 65 is a flat surface. However, the upper surface of the second cushion 65 may be spherical. In addition, a protrusion that protrudes from the upper surface of the second cushion 65 may be disposed on the displacement trajectory of the pressing part 11. Thereby, the pressing part 11 can be in contact with the second pressed part 61 at a point or in a line in the initial stage of the contact of the pressing part 11 and the second pressed part 61. Further, management of accuracy related to the inclination angle of the second portion 25 or the second cushion 65 relative to the floor can be simplified.

In the above embodiments, the extending-direction front end side of the pressing part 11 is located closer to the pedal 10 than the extending-direction base end side of the pressing part 11. However, the pressing part may extend substantially in parallel to the upper surface of the pedal 10. In that case, by making the inclination angle of the second cushion 65 relative to the floor different from the inclination angle of the pressing part relative to the floor when the pressing part contacts the second pressed part, the pressing part can be in contact with the second pressed part in a line in the initial stage of the contact of the pressing part and the second pressed part. Furthermore, management of accuracy related to the inclination angle of the second portion 25 or the second cushion 65 relative to the floor can be simplified.

According to the first embodiment, the second portion 25 of the support part 23 is located closer to the pressing part 11 than the first portion 24. According to the second embodiment, the first portion 24 of the support part 223 is located closer to the pressing part 11 than the second portion 225. However, the support part may be formed with a flat surface such that the distance from the second portion to the pressing part 11 is equal to the distance from the first portion 24 to the pressing part 11.

According to the second embodiment, the second pressed part 61 bridges the second portions 266 through the restricting parts 266 and displacement of the plate 64 is restricted by the restricting parts 266, so as to separate the second sensor 62 from the first portion 24 and prevent the first portion 24 from contacting the second sensor 62. However, the thickness dimension of the portion of the plate facing the upper surface of the second portion 225 may also be increased to separate the second sensor 62 from the first portion 24 and prevent the first portion 24 from contacting the second sensor 62. A method for increasing the thickness dimension of the plate includes increasing the thickness of the steel plate used to form the plate, or bending the plate to form a substantially U-shaped or O-shaped cross section, for example.

According to the above embodiments, the second detection device 60 includes the second sensor 62 that is made of a piezoelectric sensor affixed to the lower surface of the plate 64. However, a pressure sensor, such as a PTF (polymer thick film) device, may be interposed between the second cushion 65 and the plate 64. Moreover, a non-contact displacement sensor, such as an eddy current displacement sensor, may be used in place of the piezoelectric sensor.

What is claimed is:

1. A pedal device for an electronic percussion instrument, the pedal device comprising:

a base placed on a floor;

a pedal rotatably and pivotally supported by the base at one longitudinal end side; and a force applying member applying a force in a direction to separate the pedal from the base, wherein a first detection device for detecting a rotation of the pedal and a second detection device for detecting the rotation of the pedal by a method different from the first detection device are configured to be disposed in the base, wherein the pedal comprises a pressing part at the other longitudinal end side of the pedal, and the pressing part is disposed on a lower surface side of the pedal, the pressing part displaces with the rotation of the pedal to have a displacement trajectory, wherein the base comprises a first portion located under the pressing part for supporting the first detection device, and a second portion located around the first portion for supporting the second detection device, wherein the first detection device comprises a first pressed part configured to be disposed on the first portion and a first sensor for detecting whether the first pressed part is pressed by the pressing part, wherein the second detection device comprises a second pressed part configured to be disposed to bridge the second portion and a second sensor for detecting whether the second pressed part is pressed by the pressing part, when the first detection device is disposed, the first portion supports the first pressed part of the first detection device on the displacement trajectory of the pressing part, and when the second detection device is disposed, the second portion supports the second pressed part of the second detection device on the displacement trajectory of the pressing part.

2. The pedal device according to claim 1, wherein the second portion supports the second sensor installed on the second pressed part in a state that the second sensor faces the first portion and is separated from the first portion and does not contact the first portion.

3. The pedal device according to claim 1, wherein the second portion is formed on two sides sandwiching the pedal and located such that a distance from the second portion to a rotation shaft of the pedal is equal to a distance from the first portion to the rotation shaft of the pedal.

4. The pedal device according to claim 3, wherein a first rotation angle of the pedal required for causing the pressing part to contact the first pressed part supported by the first portion differs from a second rotation angle of the pedal required for causing the pressing part to contact the second pressed part supported by the second portion.

5. The pedal device according to claim 3, wherein a first rotation angle of the pedal that is restricted in a case when the first pressed part is supported by the first portion differs from a second rotation angle of the pedal that is restricted in a case when the second pressed part is supported by the second portion.

6. The pedal device according to claim 1, wherein the second portion is located closer to the pressing part than the first portion.

7. The pedal device according to claim 1, wherein when the base is placed on the floor, the second portion supports the second pressed part in a state that the second pressed part inclines relative to the floor.

8. The pedal device according to claim 7, wherein when the base is placed on the floor, the second portion inclines relative to the floor.

9. The pedal device according to claim 1, wherein in an initial stage where the pressing part and the second pressed part comes in contact with each other, the pressing part and the second pressed part contact each other at a point or in a line.

10. The pedal device according to claim 1, wherein the pedal and the pressing part are formed integrally by bending a plate-shaped member that is made of a steel plate.

11. A base of a pedal device for an electronic percussion instrument, wherein the base is placed on a floor and rotatably and pivotally supports one longitudinal end side of a pedal through a rotation shaft, and the pedal comprises a pressing part disposed on a lower surface side of the pedal at the other longitudinal end side of the pedal, wherein a first detection device and a second detection device for detecting a rotation of the pedal by different methods are configured to be disposed in the base, and the pressing part displaces with the rotation of the pedal to have a displacement trajectory, wherein the base comprises a first portion located under the pressing part for supporting the first detection device, and a second portion located around the first portion for supporting the second detection device, when the first detection device is disposed, the first portion supports the first detection device on the displacement trajectory of the pressing part, when the second detection device is disposed, the second portion supports the second detection device on the displacement trajectory of the pressing part, wherein a height of the first portion is different from a height of the second portion, and wherein the second portion is formed on two sides sandwiching the pedal and located such that a distance from the second portion to the rotation shaft of the pedal is equal to a distance from the first portion to the rotation shaft of the pedal.

12. The base according to claim 11, wherein the second portion is located above the first portion.

13. The base according to claim 11, wherein the second portion is located below the first portion.

14. The base according to claim 11, wherein when the base is placed on the floor, the second portion inclines relative to the floor.

15. The base according to claim 11, wherein the first detection device comprises a first pressed part configured to be disposed on the first portion and a first sensor for detecting whether the first pressed part is pressed by the pressing part, the second detection device comprises a second pressed part configured to be disposed to bridge the second portion and a second sensor for detecting whether the second pressed part is pressed by the pressing part, when the first detection device is disposed, the first portion supports the first pressed part of the first detection device on the displacement trajectory of the pressing part, and when the second detection device is disposed, the second portion supports the second pressed part of the second detection device on the displacement trajectory of the pressing part.

16. The base according to claim 15, wherein the second portion supports the second sensor installed on the second pressed part in a state that the second sensor faces the first portion and is separated from the first portion and does not contact the first portion.

17. The base according to claim 15, wherein a first rotation angle of the pedal required for causing the pressing part to contact the first pressed part supported by the first portion differs from a second rotation angle of the pedal required for causing the pressing part to contact the second pressed part supported by the second portion.

18. The base according to claim 15, wherein a first rotation angle of the pedal that is restricted in a case when the first pressed part is supported by the first portion differs from a second rotation angle of the pedal that is restricted in a case when the second pressed part is supported by the second portion.

19. The base according to claim 15, wherein when the base is placed on the floor, the second portion supports the second pressed part in a state that the second pressed part inclines relative to the floor.

20. The base according to claim 15, wherein in an initial stage where the pressing part and the second pressed part comes in contact with each other, the pressing part and the second pressed part contact each other at a point or in a line.

* * * * *